United States Patent [19]

Harnish et al.

[11] 4,102,390

[45] Jul. 25, 1978

[54] CONTROL SYSTEM FOR HEAT PUMP AND FURNACE COMBINATION

[75] Inventors: James Ranck Harnish; Larry Allan Raffensberger, both of York, Pa.

[73] Assignee: Borg-Warner Corporation, Chicago, Ill.

[21] Appl. No.: 792,751

[22] Filed: May 2, 1977

[51] Int. Cl.[2] ..... F25B 29/00

[52] U.S. Cl. ..... 165/29; 62/160; 62/278; 62/324

[58] Field of Search ..... 165/29, 17; 62/160, 62/278

[56] References Cited

U.S. PATENT DOCUMENTS 3,993,121 11/1976 Medlin et al. ..... 165/29

3,996,998 12/1976 Garst et al. ..... 165/29 X

*Primary Examiner*—Charles J. Myhre
*Assistant Examiner*—Margaret A. LaTulip
*Attorney, Agent, or Firm*—Thomas B. Hunter

[57] ABSTRACT

A residential-type, heat pump-furnace system with control means for sequencing the activation of the heat pump and furnace operation depending on the heating load. The heat pump remains operational until the air off the furnace has reached some predetermined temperature to prevent an undesirable drop in the temperature of air entering the enclosure. Also, at termination of the defrost cycle, the heat pump will resume operation in the heating mode without the compressor shutting down.

6 Claims, 5 Drawing Figures

Fig. 1.
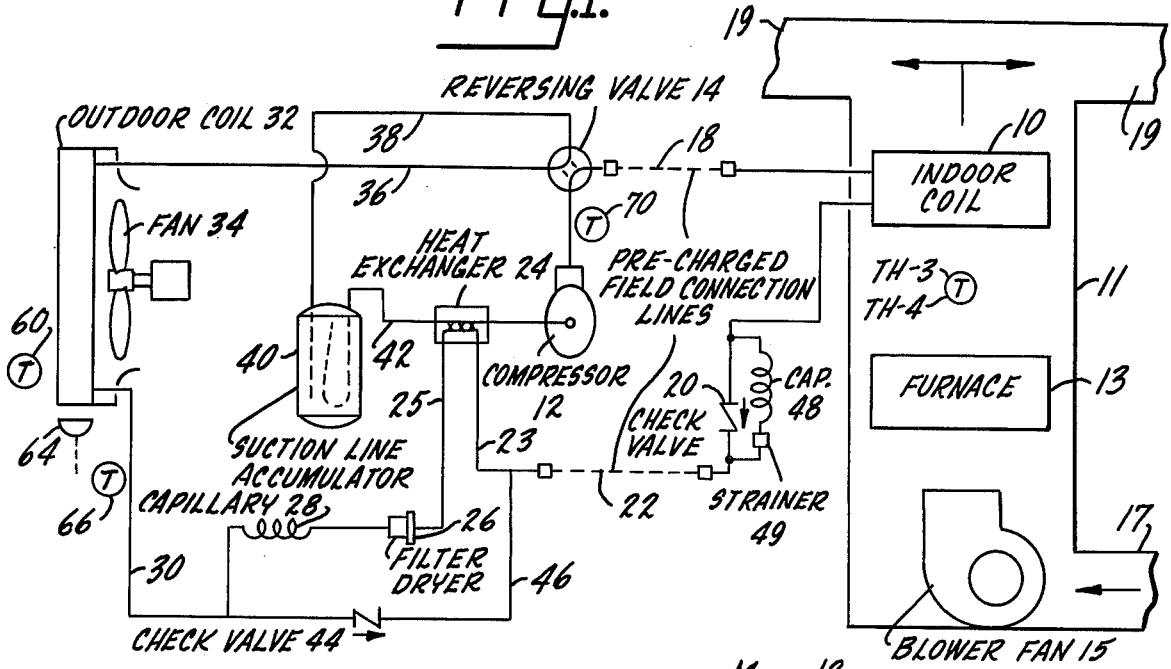
Fig. 2A.
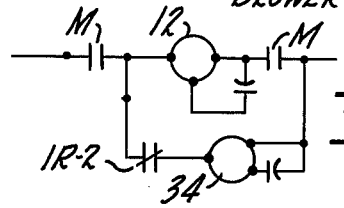
Fig. 2.
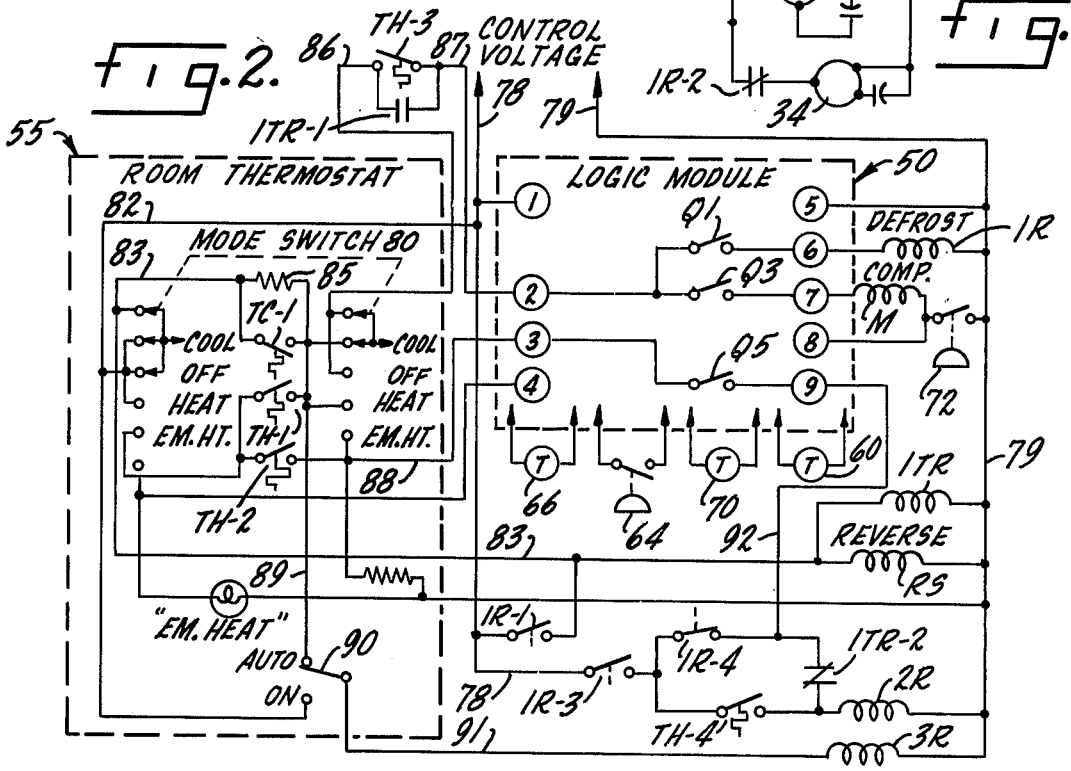
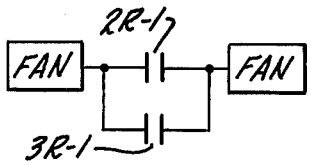
Fig. 2B.
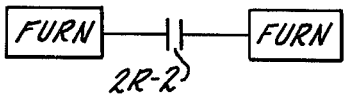
Fig. 2C.

CONTROL SYSTEM FOR HEAT PUMP AND FURNACE COMBINATION

CROSS REFERENCE TO RELATED APPLICATION

Portions of the logic circuit for controlling operation of the heat pump are described in copending U.S. patent application Ser. No. 732,674 filed on Oct. 15, 1976 by Frank E. Wills.

BACKGROUND OF THE INVENTION

1. Field of the Invention:

Combined heat-pump and furnace systems with controls for optimizing operating efficiency.

2. Description of the Prior Art:

U.S. Pat. No. 3,996,998 (Garst et al) shows a system of a type generally similar to the present invention. The disadvantage inherent in the Garst et al control is that the heat pump and the furnace are each operated along during the heating phase. When the furnace is activated under load conditions which preclude the heat pump from satisfying the load, the heat pump is simultaneously de-energized. Since it takes a period of time for the furnace to begin delivering warm air to the enclosure, cool air is supplied during this interim period causing discomfort to the occupants inside the controlled space.

SUMMARY OF THE INVENTION

The present invention relates to a heat pump control system which is especially adapted for use in connection with so-called "add-on" heat pump systems. The "add-on" system is essentially a conversion of an existing warm air furnace installation to a combination furnace and heat pump system.

In the cooling mode, the heat pump operates by delivering hot refrigerant gas from the compressor to the outside coil where the refrigerant is cooled and condensed. The high pressure liquid refrigerant is expanded through a capillary or expansion valve to the inside coil where it evaporates and abstracts heat from inside air circulating through the indoor coil.

In the heating mode, the heat pump and the furnace are coordinated in such a way that very efficient operation of the combined unit can be achieved. During light heating loads, the capacity of the heat pump is usually adequate to control the temperature of the enclosure at the desired level. However, when the heating load increases, it is desirable to switch over to furnace operation. In the present invention the heat pump is allowed to continue during this changeover for a period of time necessary to bring the temperature of the air off the furnace to a satisfactorily high level. Still another feature of the invention is a control for starting up the heat pump after a defrost cycle even though the temperature of the supply air, due to intermittent furnace operation, may still be above the cut off point. This start up procedure allows the heat pump to operate for a predetermined period of time, one to two minutes, and will then shut off the heat pump if the supply temperature is still too high.

DESCRIPTION OF THE DRAWINGS

FIG. 1 is a schematic diagram of a heat pump-furnace system embodying the principles of the present invention;

FIG. 2 is a schematic diagram of the control circuit of the present invention;

FIG. 2A is a diagram of the compressor and outdoor fan circuits;

FIG. 2B is a wiring diagram of the fan control circuit; and

FIG. 2C is a wiring diagram for the furnace control circuit.

DETAILED DESCRIPTION OF THE INVENTION

FIG. 1 shows a typical heat pump system for either heating or cooling a space as heat is pumped into or abstracted from an indoor coil 10. Refrigerant vapor is compressed in compressor 12 and delivered to a reversing valve 14, which, in its solid line position, indicates the heating mode for the system. Hot gas is delivered through a precharged field connection line 18 to the indoor coil 10 where it rejects heat into the enclosed space by the circulation of room air thereof by means of a fan 15. The refrigerant then flows through check valve 20, which would then be in its full-flow position, and then through lines 22 and 23 to heat exchanger 24, the function of which will be described below. From the heat exchanger, refrigerant passes through lines 25 to filter drier 26 and then through a capillary 28 and line 30 to the outdoor coil 32. The refrigerant abstracts heat from the air flowing over the outdoor coil as circulated by fan 34 and then flows through lines 36 to reversing valve 14, and via line 38 to the suction line accumulator 40. It then passes in indirect heat exchange relation with refrigerant flowing through line 23 and heat exchanger 24 and continues through line 42 to the suction side of compressor 12 to complete the circuit.

In the cooling mode, the reversing valve 14 is moved to its dotted line position so that refrigerant vapor compressed in compressor 12 flows through line 36 to the outdoor coil 32 where it condenses. The liquid refrigerant then flows through line 30 and check valve 44, lines 46 and 22 through capillary 48 and strainer 49 to the indoor coil 10 which now functions as an evaporator. The heat is abstracted from the indoor air causing the refrigerant to vaporize. The low pressure vapor flows through line 18, reversing valve 14 and line 38 to the suction line accumulator 40. It returns to the compressor suction through line 42.

The indoor coil 10 is located within a housing 11 which also contains a furnace 13 and an air circulating blower or fan 15. As applied to a residential installation, a return duct 17 delivers air from the enclosed space to the inlet side of blower 15. The air passes up through the heat exchanger portion of the furnace 13 and then through the indoor coil 10 to supply ducts 19 for delivery to various zones within the enclosed space.

When the system is on cooling operation, the heat pump operates as described above, and of course, the furnace is inactivated. During heating operation the furnace and the heat pump operation is coordinated in such a way that the heat pump is activated during relatively light load conditions, and as the load increases the furnace will take over. When the outdoor air is below a temperature which will not permit economic operation of the heat pump, the heat pump is inactivated.

The components described above are well known and understood in the art. The present invention is particularly directed to a control system for coordinating the heat pump operation with that of the furnace. Much of the heat pump control circuit is similar to that described in copending U.S. patent application Ser. No. 732,674 filed on Oct. 15, 1976 by Frank E. Wills. Since the details of the logic circuit, which forms no part of the present invention, are adequately described in said copending Wills application, they are incorporated herein by specific reference thereto, it being understood that other equivalent logic circuits may also be used in connection with this invention.

In connection with the logic module 50, a first temperature sensor or thermistor 60 is positioned adjacent outdoor coil 32 to sense the ambient temperature of the outdoor atmosphere. A pressure differential switch 64 is also positioned adjacent coil 32 to sense the difference in the air pressure across the outdoor coil. Another temperature sensor 66, which can be another thermistor, is positioned adjacent the line 30 to sense the temperature of the liquid in the line. Another thermistor or temperature sensor 70 is positioned as shown for providing a signal which varies as the temperature in the discharge line of the compressor. It is emphasized that this thermistor 70 provides information in addition to that provided by the usual high-pressure cut-out switch, and this is not a substitute for the information normally derived from that switch.

FIG. 2 indicates the general interconnection of the control circuit, a major component of the control system of this invention, with the just-described sensors 60, 64, 66 and 70, and a room thermostat 55, which in this embodiment is of the manual change-over type. Logic module 50 includes a plurality of terminals numbered 1–9. At the right side of FIG. 2 the usual high-pressure cut-out switch 72 for the compressor discharge line is shown, to emphasize that temperature sensor 70 provides information different than, and in addition to, that available from the cut-out switch 72.

Within the logic module are at least three "switches" Q1, Q3 and Q5. Although represented as simple mechanical switches, in a preferred embodiment the switches are triacs for passing current in either direction in response to application of a suitable gate signal and potential difference across the triac, all as described in the aforementioned Wills application. Winding M is the winding of a "compressor run" relay, so that when winding M is energized a contact set M,M (FIG. 2A) is closed to complete an energizing circuit for the compressor motor. Similarly winding 1R is the operating winding of a "defrost" relay which, when energized, opens a normally-closed contact set 1R-2 for the outdoor fan motor 34 (FIG. 2A) to prevent operation of the condenser fan motor in the defrost cycle. In addition, actuation of the defrost relay 1R closes the normally opened contact sets 1R-1 and 1R-3, and opens the normally closed contact set 1R-4.

COOLING MODE OPERATION

In general a control voltage of 24 volts is provided across the conductors 78 and 79 to energize the control system of this invention. In the showing of FIG. 2, mode switch 80 of the room thermostat is in the "cool" position. In this position a circuit is completed from line 78 over line 82, the upper left contacts of the mode switch, and line 83 to one side of winding RS for actuating reversing valve 14; the other side of this winding is coupled to line 79. Thus in the cooling position of the mode switch the reversing valve 14 is actuated to the position opposite that shown in FIG. 1.

Considering FIG. 2 again, it is evident that if switch Q3 is closed with the thermostat mode switch 80 in the illustrated "cool" position, and high-pressure cut-out switch 72 is closed indicating the compressor discharge pressure is below a predetermined cut-out valve, an energizing circuit is completed for the compressor relay winding M. This circuit extends from conductor 78 over conductor 82, the switches at the upper left of the mode switch, the contacts of cooling thermostat TC-1 (which are in parallel with the heat and cool anticipation resistor 85), the upper right contacts of the mode switch, conductor 86, the contacts of switch TH3 (closed below 87° F., open above 91° F.), conductor 87, terminal 2, the logic module switch Q3, terminal 7, winding M and high pressure switch 72 to main conductor 79. Thus the compressor motor will be energized and the compressor will be driven when the mode switch 80 is in the cool position and thermostat TC-1 is closed. If the switch Q3 is open, then the compressor motor relay winding M cannot be energized. It is also apparent that if the mode switch 80 is displaced downwardly into the "heat" position, an energizing circuit for relay winding M can be completed over the first heating stage contacts 86.

The indoor fan 15 is energized by closure of contacts 3R-1 (FIG. 2B) by relay 3R. Power is supplied to 3R through the "automatic-on" switch 90 by conductors 89, 91. The outdoor fan 34 is energized (FIG. 2A), when one of the M contacts is closed, through normally closed contacts 1R-2.

From the foregoing it is apparent that the potential on conductor 78 can be extended over conductors 82, 86 and 87 and the thermostat contacts TC-1 to terminal 2 of the logic module 50. It is further apparent that if switch Q1 is closed, this will complete a circuit over terminal 6 of the logic module to the left side of defrost initiate relay winding 1R, the other side of which is coupled to conductor 79. For the present, it is sufficient to note that the closure of switch Q1 in effect initiates the defrost cycle of the equipment.

HEATING MODE OPERATION

With the mode switch 80 in the "heat" position, the unit is adapted to coordinate the operation of the heat pump and the furnace to satisfy the demand for heating in an efficient manner. Efficiency, however, is not sacrificed for the sake of the occupants' comfort.

By way of example, the first stage heating thermostat TH-1 may be set to open at 74° F. and close at 72° F. Second stage thermostat TH-2 may be set to open at 70° F. and close at 68° F.

LIGHT LOAD HEATING

Handling a light heating load is basically under the control of TH-1. With TH-1 closed, calling for heat, the control voltage is carried over conductors 78 and 82, through the left-hand contacts of the mode switch, then the TH-1 contacts and the right-hand contacts of mode switch 80 to conductor 86. TH-3 will be closed (below about 92° F.) carrying power to terminal 2 via line 87. With Q3 closed, the compressor relay is energized to start the compressor. It is noted that the left-hand contacts of mode switch 80 do not complete a circuit, as in the cooling mode, to reversing valve solenoid RS. Thus, the reversing valve assumes the solid line position shown in FIG. 1 and the hot gas is delivered first to the indoor coil, as described above, for heating. At the same time, the fan motor relay 3R is energized through the "automatic-on" switch 90 initiating operation of fan 15. If the heating demand is satisfied, the contacts of TH-1 open (at 74° F., for example), and the compressor and fan are de-energized.

MODERATE LOAD HEATING

Assume that the system has been operating on heat pump (heating mode) for some time and the indoor temperature continues to drop. The second stage thermostat TH-2 will eventually close (at about 68° F.) completing a circuit through conductor 88 to terminal 3, closed switch Q5, terminal 9, conductor 92, normally closed contacts 1TR-2 and relay winding 2R. This will close contacts 2R-2 (FIG. 2C) to activate the furnace 13. Relay 2R will also close contacts 2R-1 to the indoor fan 15 (FIG. 2B). The fan, however, is already energized through parallel contacts 3R-1.

At this point, the heat pump continues to operate to avoid the rapid drop in temperature which would result from turning off the heat pump immediately upon furnace activation. The temperature of the air in the plenum 11 off the furnace 13 will begin to increase. When it rises to about 91°–92° F., the double pole thermostat TH3/TH4 will open its contacts. This results in the circuit through TH-3 being broken between conductors 86 and 87 thus de-energizing the compressor relay winding M and discontinuing heat pump operation.

If the indoor temperature should rise to about 70° F. the furnace will be shut off by opening the contacts of TH-2. The heat pump will not be activated again for some predetermined period (about 5 minutes), no matter what happens, because of a built in time delay in the logic module. Each time the compressor is shut off, whether on heating or cooling, a timer holds switch Q3 open for a five minute period to prevent a re-start which could cause compressor stress.

DEFROST CYCLE

During operations of the heat pump in the heating mode, the outdoor coil is, of course, the cold coil. This results in frost being built up on the coil which requires a defrost cycle.

In the present invention, a pressure device 64 measures air pressure drop across the outside coil and carries out a series of operations within the logic module. First of all, switch Q1 is closed energizing the defrost relay coil 1R. This causes switches 1R-1 and 1R-3 to close and 1R-4 to open. Switch 1R-2 opens to de-energize the outdoor fan motor 34.

The reversing valve 14 is switched to its alternate position to deliver hot gas to the outside coil to remove the frost. This occurs as follows: power is carried through conductor 78, closed switch 1R-1 and line 83 to relay winding RS, the opposite side of which is coupled to conductor 79. At the same time, time delay relay 1TR is energized through a parallel path.

With plenum temperature below about 92° F. as measured by TH-3/TH-4, the furnace solenoid 2R is energized through 1R-3 and TH-4 to supply some heat, even if the second stage thermostat TH-2 is still open. This is to prevent cool drafts caused by the air circulating over the now cold indoor coil. The furnace will cycle off and on during the defrosting period under the control of TH-4.

A very important feature of this invention concerns the control of the heat pump after termination of defrost. When the defrosting cycle is completed, as determined by the logic module and associated sensors, switch Q1 is opened to de-energize relay coil 1R. This opens switches 1R-1 and 1R-3, and closes 1R-4. Switch 1R-2 is closed to energize the outdoor fan motor 34. In the ordinary system, if TH-3 were open, due to residual furnace heat, a circuit could not be completed (through line 87, terminal 2, switch Q3, and terminal 7) to the compressor relay. However, in this system, switch 1TR-1 under the control of 1TR and bypassing TH-3, remains closed for 1-2 minutes after 1TR is de-energized. This avoids turning off the compressor after termination of the defrost cycle. During this period of time the furnace cools down closing TH-3. If it does not cool down TH-3 and 1TR-1 will be open, shutting down the heat pump. However, if it hasn't, the contacts of 1TR-1 open and the heat pump compressor is shut off.

When the outside ambient temperatures are so low (about 10° F.) that heat pump operation is inefficient, the ambient air sensor 60 is operative to open switch Q-3 in the logic module and prevent actuation of the compressor. At this time, the load must be handled by the furnace alone.

It will be noted on FIG. 2 that the mode switch 80 has an "emergency heat" position. In this case, the furnace operation can bypass the control of the second stage thermostat. The two lower right-hand terminals of the mode switch are connected so that when TH-1 is closed, power is conducted via line 88, terminal 3, switch Q5, terminal 9, conductor 92 and 1TR-2 to furnace relay 2R.

While this invention has been described in connection with a certain specific embodiment thereof, it is to be understood that this is by way of illustration and not by way of limitation; and the scope of the appended claims should be construed as broadly as the prior art will permit.

What is claimed is:

1. A combination heat pump-furnace system for delivering conditioned air to an enclosure comprising: a heat pump including an inside coil, a compressor and an outside coil all connected in series flow relation, said heat pump further including a reversing valve for selectively directing refrigerant from said compressor to said indoor coil for heating mode operation, or to said outdoor coil for cooling mode operation; a furnace having a heat exchanger section upstream from said indoor coil; means for circulating air through said furnace heat exchanger and then through said indoor coil to said enclosure; first thermostatic means for controlling the operation of said heat pump during heating mode operation; second thermostatic means for controlling the operation of said furnace, said second thermostatic means actuating said furnace when the temperature of air in said enclosure reaches a predetermined low threshold level; third thermostatic means between said furnace heat exchanger and said indoor coil for sensing the air temperature off said furnace heat exchanger; and relay means controlled by said third thermostatic means for discontinuing operation of said heat pump on heating mode only after the temperature, as sensed by said third thermostatic means, reaches some predetermined level to thereby prevent a noticeable drop in the temperature of air supplied to said enclosure which may be caused by premature deactivation of said heat pump.

2. The combination as defined in claim 1 including cooling mode thermostatic means adapted to control the operation of said heat pump when operating in the cooling mode.

3. A combination as defined in claim 1 including means for sensing the need for defrosting said outside coil when said heat pump is operating in the heating mode, said means including a defrost cycle termination sensor; means for actuating said furnace intermittently during the defrost cycle; means for resuming operation of the heat pump in the heating mode without shutting off said compressor for a predetermined period of time after said defrost cycle termination sensor indicates that the defrost cycle has been completed; and means for discontinuing operation of said heat pump after said time has elapsed if the temperature of air being circulated through said indoor coil is not below a predetermined level.

4. The combination as defined in claim 3 including switch means coupled in parallel with said third thermostatic means; and a time delay relay controlled by said defrost cycle termination sensor, said time delay relay being operative to maintain said switch means closed, to bypass said third thermostatic means, for a predetermined time after the defrost cycle is terminated.

5. The combination as defined in claim 4 wherein said predetermined time is 1–2 minutes.

6. A heat pump system comprising: an inside coil, a compressor and an outside coil all connected in series flow relation, said heat pump further including a reversing valve for selectively directing refrigerant from said compressor to said indoor coil for heating mode operation, or to said outdoor coil for cooling mode operation; means for sensing the need for defrosting said outside coil when said heat pump is operating in the heating mode, said means including a defrost cycle termination sensor; means for supplying heat to said enclosure intermittently during the defrost cycle; means for resuming operation of the heat pump in the heating mode without shutting off said compressor for a predetermined period of time after said defrost cycle termination sensor indicates that the defrost cycle has been completed; and means for discontinuing operation of said heat pump after said time has elapsed if the temperature of air being circulated through said indoor coil is not below a predetermined level.

* * * * *